US009912029B2

(12) United States Patent
Morgan et al.

(10) Patent No.: US 9,912,029 B2
(45) Date of Patent: Mar. 6, 2018

(54) WAVEGUIDE ASSEMBLY HAVING A PLURALITY OF DIELECTRIC WAVEGUIDES SEPARATED BY A SHIELD

(71) Applicants: TYCO ELECTRONICS CORPORATION, Berwyn, PA (US); Tyco Electronics (Shanghai) Co., Ltd., Shanghai (CN)

(72) Inventors: Chad William Morgan, Carneys Point, NJ (US); Liang Huang, Chengdu (CN)

(73) Assignees: TE CONNECTIVITY CORPORATION, Berwyn, PA (US); TYCO ELECTRONICS (SHANGHAI) CO., LTD., Shanghai (CN)

( * ) Notice: Subject to any disclaimer, the term of this patent is extended or adjusted under 35 U.S.C. 154(b) by 100 days.

(21) Appl. No.: 15/002,539

(22) Filed: Jan. 21, 2016

(65) Prior Publication Data

US 2017/0170538 A1 Jun. 15, 2017

(30) Foreign Application Priority Data

Dec. 14, 2015 (CN) ..... 2015 1 0925262

(51) Int. Cl.
*H01P 3/16* (2006.01)

(52) U.S. Cl.
CPC ..... *H01P 3/16* (2013.01)

(58) Field of Classification Search
CPC .... H01P 3/16; H01P 3/20; H01P 3/121; H01P 3/122
USPC ..... 333/1, 239, 241, 242
See application file for complete search history.

(56) References Cited

U.S. PATENT DOCUMENTS

| | | | | |
|---|---|---|---|---|
| 2,829,351 | A | 4/1958 | Fox | |
| 4,216,449 | A | 8/1980 | Kach | |
| 4,525,693 | A | 6/1985 | Suzuki et al. | |
| 4,875,026 | A | 10/1989 | Walter et al. | |
| 2012/0306587 | A1* | 12/2012 | Strid et al. | H01P 3/16 333/1 |
| 2014/0240187 | A1 | 8/2014 | Herbsommer et al. | |
| 2014/0285291 | A1 | 9/2014 | Payne et al. | |
| 2014/0368301 | A1 | 12/2014 | Herbsommer et al. | |
| 2015/0327357 | A1 | 11/2015 | Khan et al. | |
| 2017/0170539 | A1 | 6/2017 | Morgan et al. | |
| 2017/0170540 | A1 | 6/2017 | Morgan et al. | |

* cited by examiner

*Primary Examiner* — Benny Lee

(57) ABSTRACT

A waveguide assembly for propagating electromagnetic signals includes first and second dielectric waveguides and a shield. Each of the first and second dielectric waveguides includes a cladding formed of a first dielectric material. The cladding defines a core region therethrough that is filled with a second dielectric material different than the first dielectric material. The shield is disposed between the first dielectric waveguide and the second dielectric waveguide. The shield is electrically conductive. The shield does not surround an entire perimeter of either of the first dielectric waveguide or the second dielectric waveguide.

21 Claims, 5 Drawing Sheets

WAVEGUIDE ASSEMBLY HAVING A PLURALITY OF DIELECTRIC WAVEGUIDES SEPARATED BY A SHIELD

CROSS-REFERENCE TO RELATED APPLICATIONS

This application claims priority to Chinese Patent Application No. 201510925262.3, filed on 14 Dec. 2015, which is incorporated by reference herein in its entirety.

BACKGROUND OF THE INVENTION

The subject matter herein relates generally to assemblies with multiple dielectric waveguides.

Dielectric waveguides are used in communications applications to convey signals in the form of electromagnetic waves along a path. Dielectric waveguides provide communication transmission lines for connecting communication devices, such as connecting an antenna to a radio frequency transmitter and/or receiver. Although waves in open space propagate in all directions, dielectric waveguides generally confine the waves and direct the waves along a defined path, which allows the waveguides to transmit high frequency signals over relatively long distances.

Dielectric waveguides include at least one dielectric material, and typically have two or more dielectric materials. A dielectric is an electrical insulating material that can be polarized by an applied electrical field. The polarizability of a dielectric material is expressed by a value called the "dielectric constant" or "relative permittivity." The dielectric constant of a given material is its dielectric permittivity expressed as a ratio relative to the permittivity of a vacuum, which is 1 by definition. A first dielectric material with a greater dielectric constant than a second dielectric material is able to store more electrical charge by means of polarization than the second dielectric material.

Some known dielectric waveguides include a core dielectric material and a cladding dielectric material that surrounds the core dielectric material. The dielectric constants, in addition to the dimensions and other parameters, of each of the core dielectric material and the cladding dielectric material affect how an electromagnetic field through the waveguide is distributed within the waveguide. In known dielectric waveguides, the electromagnetic field typically has a distribution that extends radially through the core dielectric material, the cladding dielectric material, and even partially outside of the cladding dielectric material (for example, within the air outside of the waveguide).

There are several issues associated with portions of the electromagnetic field extending outside of the cladding of the dielectric waveguide into the surrounding environment. First, the portions of the electromagnetic field outside of the waveguide may produce high crosstalk levels when multiple dielectric waveguides are bundled together in a cable, and the level of crosstalk may increase with higher modulated frequencies propagating through the waveguides. Second, some electromagnetic fields in air may travel faster than fields that propagate within the waveguide, which leads to the undesired electrical effect called "dispersion." Dispersion occurs when some frequency components of a signal travel at a different speed than other frequency components of the signal, resulting in inter-signal interference. Third, the dielectric waveguide may experience interference and signal degradation due to external physical influences that interact with the electromagnetic field, such as a human hand touching the dielectric waveguide. Finally, portions of the electromagnetic field outside of the waveguide may be lost along bends in the waveguide, as uncontained fields tend to radiate away in a straight line instead of following the contours of the waveguide.

One potential solution for at least some of these issues is to increase the overall diameter of the dielectric waveguides, such as by increasing the diameter of the cladding layer or the diameter of a dielectric outer jacket layer that surrounds the cladding layer. Increasing the amount of dielectric material provides better field containment and reduces the amount or extent of the electromagnetic field propagating outside of the waveguide. But, increasing the size of the dielectric waveguide introduces other drawbacks, including reduced flexibility of the waveguides, increased material costs, and a reduced number of waveguides that can fit within a given area or space (for example, reducing the density of waveguides).

Another potential solution is to provide an electrically conductive shielding layer that encircles or surrounds the waveguides along a full outer perimeter thereof, such as by wrapping the dielectric waveguides in a conductive foil. But, electrically conductive shielding layers can cause undesirably high energy loss levels (for example, insertion loss and/or return loss) in the waveguides as portions of the electromagnetic fields induce surface currents in the conductive material. High loss levels shorten the effective length that an electromagnetic wave will propagate through the waveguide. Furthermore, outer metal shielding layers interacting with the propagating electromagnetic waves can allow undesirable modes of propagation that have hard cutoff frequencies. For example, at some specific frequencies, the shielding layers can completely halt or "cutoff" the desired field propagation.

A need remains for an assembly of multiple dielectric waveguides for propagating high frequency electromagnetic signals in which the dielectric waveguides of the assembly have a compact size and a reduced sensitivity to external influences (for example, crosstalk and other interference), while providing acceptably low levels of loss and avoiding unwanted mode propagation.

SUMMARY OF THE INVENTION

In an embodiment, a waveguide assembly for propagating electromagnetic signals is provided that includes first and second dielectric waveguides and a shield. Each of the first and second dielectric waveguides includes a cladding formed of a first dielectric material. The cladding defines a core region therethrough that is filled with a second dielectric material different than the first dielectric material. The shield is disposed between the first dielectric waveguide and the second dielectric waveguide. The shield is electrically conductive.

In another embodiment, a waveguide assembly is provided that extends a length between a first end and a second end. The waveguide assembly includes a transmit dielectric waveguide, a receive dielectric waveguide, and a dielectric outer jacket. The transmit dielectric waveguide includes a cladding formed of a first dielectric material. The cladding defines a core region therethrough that is filled with a second dielectric material different than the first dielectric material. The transmit dielectric waveguide propagates electromagnetic signals in an outgoing direction from the first end of the waveguide assembly towards the second end. The receive dielectric waveguide includes a cladding formed of a first dielectric material. The cladding defines a core region therethrough that is filled with a second dielectric material different than the first dielectric material. The receive dielectric waveguide propagates electromagnetic signals in an incoming direction from the second end of the waveguide assembly towards the first end. The dielectric outer jacket engages and commonly surrounds the cladding of the transmit and receive dielectric waveguides.

In another embodiment, a waveguide assembly for propagating electromagnetic signals is provided that includes an electrically conductive shield, a first pair of dielectric waveguides, and a second pair of dielectric waveguides. The shield is elongated between a first end and a second end. The shield has a first side and an opposite second side. The first pair of dielectric waveguides extends between the first and second ends and is disposed on the first side of the shield. The second pair of dielectric waveguides extends between the first and second ends and is disposed on the second side of the shield. Each of the first and second pairs includes a transmit waveguide and a receive waveguide. The transmit waveguides propagate electromagnetic signals in an outgoing direction from the first end towards the second end. The receive waveguides propagate electromagnetic signals in an incoming direction from the second end towards the first end. Each of the dielectric waveguides in the first and second pairs has a cladding formed of a first dielectric material. The respective cladding of each of the dielectric waveguides defines a core region therethrough that is filled with a second dielectric material different than the first dielectric material.

DETAILED DESCRIPTION OF THE INVENTION

One or more embodiments described herein are directed to a waveguide assembly that includes multiple dielectric waveguides. The embodiments of the waveguide assembly employ a select amount and location of metal shielding relative to the dielectric waveguides to lower crosstalk between the waveguides while at the same time not introducing unwanted mode propagation or undesirably high levels of loss in the waveguides. Lower loss levels allow the waveguides to convey signals farther along a defined path. For example, the metal shielding extends between at least some adjacent dielectric waveguides but does not extend on all sides or around an entire circumference of the dielectric waveguides.

At least some embodiments of the waveguide assembly are directed to cable bundles of multiple dielectric waveguides, where at least one of the waveguides is a transmit waveguide that is used to convey outgoing signals from a reference location to a remote location and at least one of the waveguides (different from the at least one transmit waveguide) is a receive waveguide that is used to convey incoming signals to the reference location from the remote location. Electromagnetic coupling or crosstalk between two waveguides that are both transmit waveguides or that are both receive waveguides is referred to as far end crosstalk ("FEXT"), while crosstalk between a transmit waveguide and a receive waveguide is referred to as near end crosstalk ("NEXT"). Far end crosstalk is generally at higher levels than near end crosstalk, so near end crosstalk is generally more desirable than far end crosstalk to reduce the level of interference and signal degradation. In one or more of the embodiments, cable bundles include transmit waveguides grouped in pairs with receive waveguides. Adjacent pairs are separated by an electrically conductive shield in order to eliminate or at least reduce far end crosstalk (between the transmit waveguides in the adjacent pairs and between the receive waveguides in the adjacent pairs). Thus, all or at least most of the crosstalk in the cable bundle is near end crosstalk which is less detrimental than the far end crosstalk. By pairing transmit and receive waveguides together and selectively positioning metal shielding between adjacent pairs of waveguides, a limited amount of metal may be employed in the cable bundle in order to achieve acceptably low crosstalk levels, acceptably low loss, and avoidance of unwanted modes.

Figure 1:
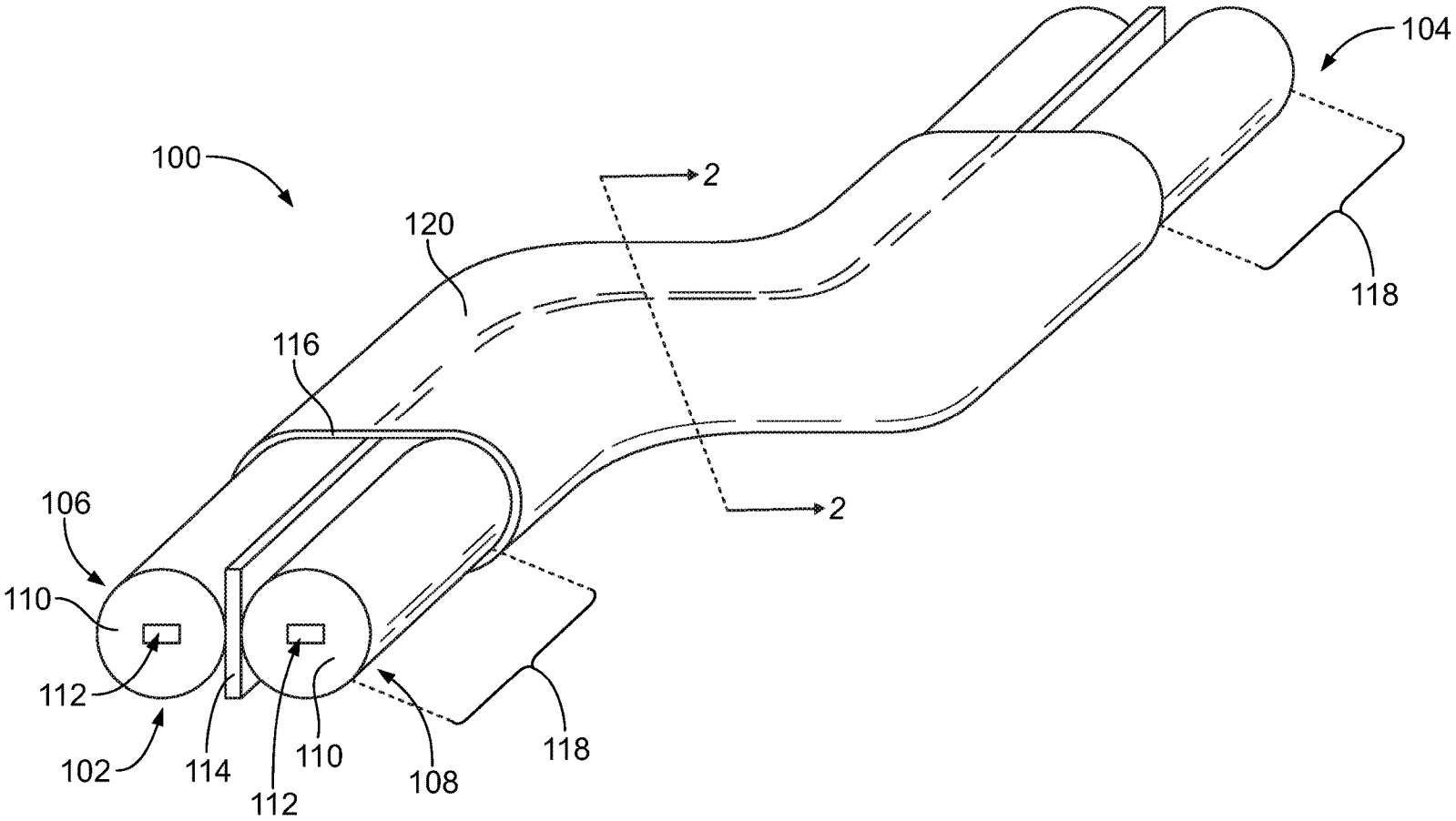
FIG. 1 is a top perspective view of a waveguide assembly formed in accordance with an embodiment.

FIG. 1 is a top perspective view of a waveguide assembly 100 formed in accordance with an embodiment. The waveguide assembly 100 is configured to convey signals in the form of electromagnetic waves or fields along a length of the waveguide assembly 100 for transmission of the signals between two communication devices (not shown). The communication devices may include antennas, radio frequency transmitters and/or receivers, computing devices (for example, desktop or laptop computers, tablets, smart phones, etc.), media storage devices (for example, hard drives, servers, etc.), network interface devices (for example, modems, routers, etc.), and the like. The waveguide assembly 100 may be used to transmit high speed signals in the sub-terahertz radio frequency range, such as 120-160 gigahertz (GHz). The high speed signals in this frequency range have wavelengths less than five millimeters. The waveguide assembly 100 may be used to transmit modulated radio frequency (RF) signals.

The waveguide assembly 100 is elongated to extend a length between a first end 102 and a second end 104. The length of the waveguide assembly 100 may be in the range of one meter to 50 meters. The length is dependent on the distance between the two communication devices to be connected, but other factors involve the potential length of the waveguide assembly 100, including the physical size, structure, and materials of the waveguide assembly 100, the frequency of the signals propagating through the waveguide assembly 100, the signal integrity requirements, and the presence of external influences that may cause interference. One or more waveguide assemblies 100 disclosed herein have lengths in the range of 10-25 meters and can convey high speed electromagnetic signals having frequencies between 120 and 160 GHz with acceptable signal quality according to defined standards. In order to connect communication devices that are spaced apart by a distance that is longer than the length of a single waveguide assembly 100, the waveguide assembly 100 may be joined with one or more other waveguide assemblies 100.

The waveguide assembly 100 includes at least a first dielectric waveguide 106 and a second dielectric waveguide 108 (which are referred to herein as first and second waveguides 106, 108). The first and second waveguides 106, 108 may be identical or at least substantially similar. For example, the waveguides 106, 108 may be composed of the same materials, have the same lengths and shapes, and/or may be formed using a common manufacturing process. In an alternative embodiment, the first and second waveguides 108 may be at least slightly different, such as by being composed of at least some different materials.

Each of the first and second dielectric waveguides 106, 108 include a cladding 110 formed of a first dielectric material. The cladding 110 extends the length of the waveguide assembly 100 between the first and second ends 102, 104. The cladding 110 defines a core region 112 therethrough along the length of the cladding 110. The core region 112 is filled with a second dielectric material that is different than the first dielectric material. As used herein, dielectric materials are electrical insulators that may be polarized by an applied electric field. The first dielectric material of the cladding 110 surrounds the second dielectric material of the core region 112. The first dielectric material of the cladding 110 is referred to herein as a "cladding material," and the second dielectric material in the core region 112 is referred to herein as a "core material." The core material has a dielectric constant value that is different than the dielectric constant value of the cladding material. The core material in the core region 112 may be in the solid phase or the gas phase. For example, the core material may be a solid polymer such as polyethylene, polypropylene, polytetrafluoroethylene (PTFE), or the like. Alternatively, the core material may be one or more gases, such as air.

The respective dielectric constants of the core material and the cladding material affect the distribution of an electromagnetic field (or wave) within each of the dielectric waveguides 106, 108. Generally, an electromagnetic field through a dielectric waveguide concentrates within the material that has the greater dielectric constant, at least for materials with dielectric constants in the range of 0-15. In an embodiment, the dielectric constant of the core material in the core region 112 is greater than the dielectric constant of the cladding material, such that electromagnetic fields generally concentrate within the core region 112, although minor portions of the electromagnetic fields may be distributed within the cladding 110 and/or outside of the cladding 110. In another embodiment, the dielectric constant of the core material is less than the dielectric constant of the cladding material, so the electromagnetic fields concentrate generally within the cladding 110, and may have minor portions within the core region 112 radially interior of the cladding 110 and/or outside of the cladding 110.

In an embodiment, the waveguide assembly 100 further includes an electrically conductive shield 114 that is disposed between the first and second dielectric waveguides 106, 108. The shield 114 is composed of one or more metals that provide the shield 114 with electrically conductive properties. The shield 114 provides electromagnetic shielding between the two waveguides 106, 108 to eliminate or at least reduce crosstalk and other interference between the two waveguides 106, 108. For example, due to the close proximity of the first and second waveguides 106, 108 to one another, portions of an electromagnetic wave propagating through the first waveguide 106 that are outside of the cladding 110 have a tendency to couple to or otherwise interact with the second waveguide 108. The inverse phenomenon from the second waveguide 108 to the first waveguide 106 may also occur, causing signal degradation in both waveguides 106, 108. The shield 114 is configured to reflect and/or shield electromagnetic waves in the area between the waveguides 106, 108, thereby preventing or at least reducing crosstalk.

In an exemplary embodiment shown in FIG. 1, the shield 114 does not surround an entire perimeter of either of the first waveguide 106 or the second waveguide 108. For example, the first and second waveguides 106, 108 have rounded perimeters, but the shield 114 does not extend circumferentially around the entire rounded perimeters of the waveguides 106, 108 individually or collectively. In the illustrated embodiment, the shield 114 is generally planar. The shield 114 is a divider wall disposed axially and laterally between the waveguides 106, 108. The shield 114 is elongated and extends longitudinally along at least a portion of the length of the waveguide assembly 100 between the two ends 102, 104. Thus, the shield 114 prevents the first waveguide 106 along at least a portion of the length thereof from being exposed directly to the second waveguide 108, which would allow crosstalk.

The waveguide assembly 100 in an embodiment further includes an outer jacket 116. The outer jacket 116 is composed of a dielectric material. The outer jacket 116 collectively surrounds the first and second waveguides 106, 108 and the shield 114 therebetween. The outer jacket 116 supports the structure of the waveguide assembly 100 by retaining the relative positions of the first and second waveguides 106, 108 and the shield 114. In the illustrated embodiment, the outer jacket 116 does not extend the full length of the waveguide assembly 100 such that exposed segments 118 of the waveguides 106, 108 and the shield 114 at the first and second ends 102, 104 protrude from and are not covered by the outer jacket 116. The exposed segments 118 may be used for connecting the waveguide assembly 100 to a communication device or another waveguide assembly 100. In an alternative embodiment, the outer jacket 116 may extend the full length of the waveguide assembly 100 and/or may define only one exposed segment 118 instead of two. The outer jacket 116 defines an outer boundary 120 of the waveguide assembly 100 (except along the exposed segments 118). In addition to providing structural support, the outer jacket 116 may contain some of the electromagnetic waves that extend outside of the respective claddings 110 of the first and second waveguides 106, 108. Thus, the outer jacket 116 may be a buffer between the waveguides 106, 108 and the outer boundary 120 of the waveguide assembly 100, which improves the sensitivity of the waveguide assembly 100 to disturbances caused by human handling and other external contact with the outer boundary 120 of the waveguide assembly 100.

Figure 2:
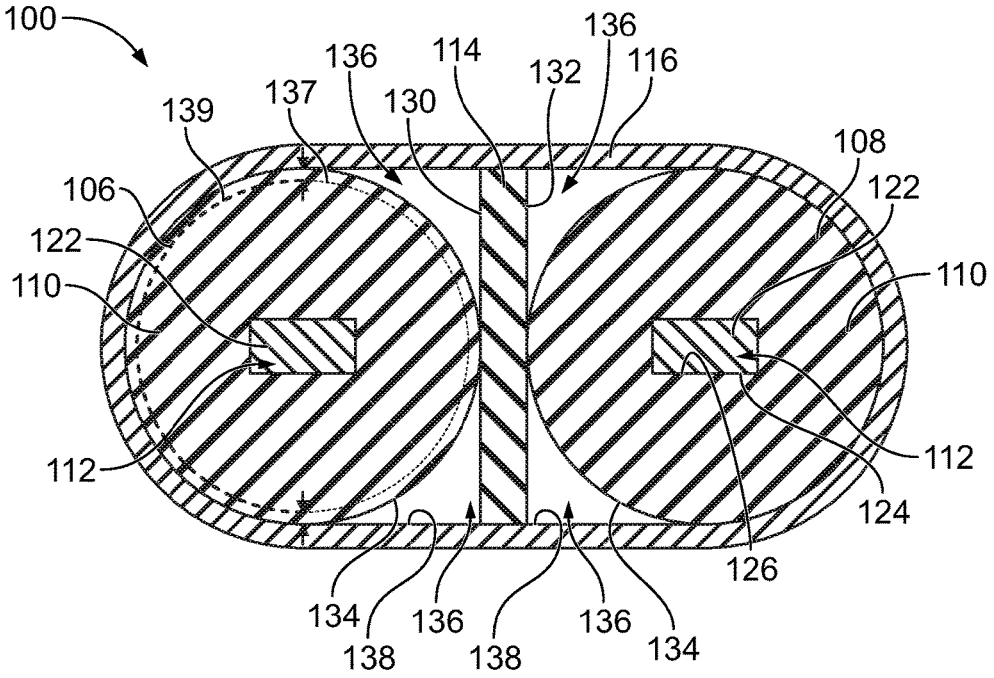
FIG. 2 is a cross-sectional view of the embodiment of the waveguide assembly shown in FIG. 1 taken along line 2-2 shown in FIG. 1.

FIG. 2 is a cross-sectional view of the embodiment of the waveguide assembly 100 shown in FIG. 1 taken along line 2-2 shown in FIG. 1. In the illustrated embodiment, the claddings 110 of both the first and second waveguides 106, 108 have circular cross-sectional shapes. The diameter of each of the claddings 110 may be between 1 and 10 mm, or more specifically between 2 and 4 mm. The core regions 112 have rectangular cross-sectional shapes. The rectangular shapes of the core regions 112 may orient the respective electromagnetic waves propagating therethrough in a horizontal or vertical polarization. The cross-sectional area of each of the core regions 112 may be between 0.08 and 3 $mm^2$, or more specifically between 0.1 and 1 $mm^2$.

In the illustrated embodiment, the first and second waveguides 106, 108 each include a solid core member 122 within the respective core region 112. The core member 122 is composed of at least one dielectric polymer material (that defines the core material), such as polypropylene, polyethylene, PTFE, polystyrene, a polyimide, a polyamide, or the like, including combinations thereof. The core member 122 fills the core region 112 such that no clearances or gaps exist between an outer surface 124 of the core member 122 and an inner surface 126 of the cladding 110 defining the core region 112. The cladding 110 therefore engages and surrounds the core member 122 along the length of the core member 122. In an alternative embodiment, the core material may be air or another gas-phase dielectric material instead of the solid core member 122. Air has a low dielectric constant of approximately 1.0.

The cladding 110 of each of the first and second waveguides 106, 108 is composed of a dielectric polymer material, such as polypropylene, polyethylene, PTFE, polystyrene, a polyimide, a polyamide, or the like, including combinations thereof. These materials generally have low loss characteristics which allow the waveguides 106, 108 to transmit the signals for longer distances. The cladding material is different than the core material for each waveguide 106, 108, such that the dielectric constant of the respective waveguide 106, 108 changes upon crossing an interface between the core member 122 and the cladding 110. The first and second waveguides 106, 108 may be fabricated by extrusion, drawing, fusing, molding, or the like.

The shield 114 may be formed of one or more metals or metal alloys, including copper, aluminum, silver, or the like. Alternatively, the shield 114 may be a conductive polymer formed by dispersing metal particles within a dielectric polymer. The shield 114 may be in the form of a foil, a conductive tape, a thin panel of sheet metal, or the like. The shield 114 in the illustrated embodiment is planar and includes a first side 130 and an opposite second side 132. The shield 114 is disposed between the first and second waveguides 106, 108 such that the first waveguide 106 is disposed along the first side 130 of the shield 114 and the second waveguide 108 is along the second side 132. As mentioned above, the shield 114 does not surround an entire perimeter of either of the first waveguide 106 or the second waveguide 108. For example, the perimeter of the first waveguide 106 includes an inner half 137 and an outer half 139 that together define the entire perimeter. The inner half 137 faces the second waveguide 108, while the outer half 139 faces away from the second waveguide 108. In the illustrated embodiment, the inner half 137 is shielded by the shield 114 and the outer half 139 is unshielded. Although not labeled in FIG. 2, the perimeter of the second waveguide 108 also includes an inner half that faces the first waveguide 106 and is shielded by the shield 114 and an outer half that faces away from the first waveguide 106 and is unshielded.

Although outer surfaces 134 of the first and second waveguides 106, 108 are shown as directly mechanically engaging the corresponding first and second sides 130, 132, respectively, of the shield 114, in other embodiments the first and/or second waveguide 106, 108 may be spaced apart and not in direct mechanical contact with the shield 114. The first and second sides 130, 132 are both planar in FIG. 2 and do not curve along the circumference of the corresponding waveguides 106, 108. But, in an alternative embodiment, the first side 130 and/or the second side 132 may be curved and may extend along a portion of the circumference of the corresponding waveguide 106, 108 without fully surrounding or encircling the corresponding waveguide 106, 108. For example, the first and/or second sides 130, 132 may curve along a portion that is less than half or less than one-fourth of the circumference of the corresponding waveguide 106, 108.

The outer jacket 116 in the illustrated embodiment has an oblong cross-sectional shape. The outer jacket 116 may be a wrap, a tape, a heat shrink tubing, or the like, that commonly surrounds both of the waveguides 106, 108 and the shield 114 and holds the components together. For example, the outer jacket 116 may be applied by winding or wrapping the dielectric jacket material around the waveguides 106, 108 and the shield 114. In the case of a heat shrink tubing, the waveguides 106, 108 and the shield 114 may be inserted into a channel defined by the outer jacket 116, and then heat and/or high pressure is applied to the assembly such that the outer jacket material shrinks and conforms to the contours of the internal components. The waveguide assembly 100 may define one or more small gaps or interstices 136 between the outer surfaces 134 of the waveguides 106, 108, the shield 114, and an interior surface 138 of the outer jacket 116.

Figure 3:
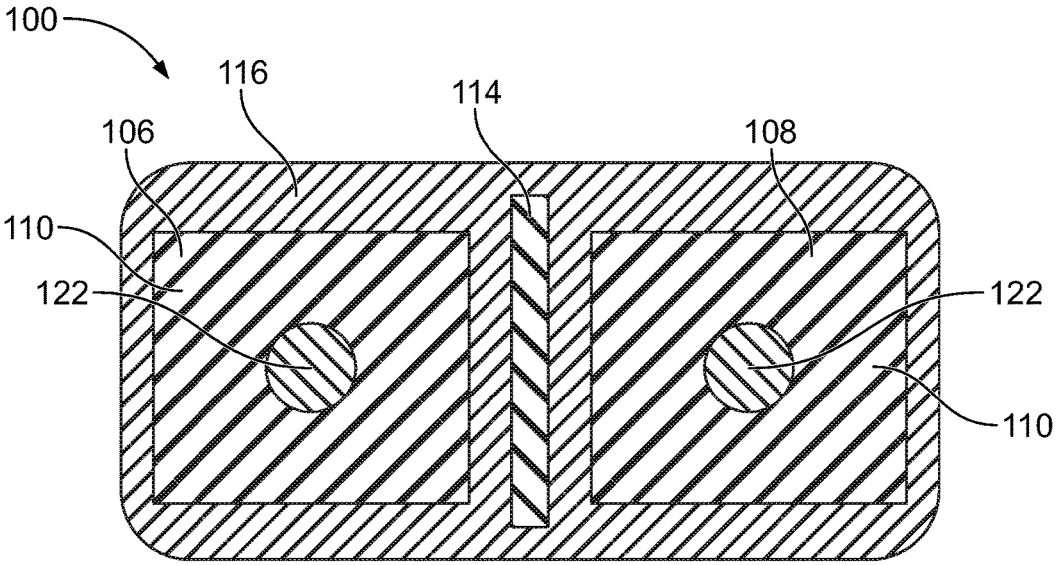
FIG. 3 is a cross-sectional view of another embodiment of the waveguide assembly.

FIG. 3 is a cross-sectional view of another embodiment of the waveguide assembly 100. The first and second waveguides 106, 108 have different cross-sectional shapes in the illustrated embodiment compared to the embodiment shown in FIGS. 1 and 2. For example, the claddings 110 have oblong shapes, meaning that each of the claddings 110 has a greater length in one dimension relative to a perpendicular dimension. In the illustrated embodiment, the claddings 110 are both rectangular, but in other embodiments, the claddings 110 may have other oblong shapes, such as ellipses, ovals, rectangular with rounded corners, or the like. The oblong shape of the cladding 110 may be used to orient the polarization of the electromagnetic fields through the corresponding waveguides 106, 108. The core member 122 of each of the waveguides 106, 108 has a circular cross-sectional shape in FIG. 3. In other embodiments, the core members 122 and the claddings 110 may both be circular or may both be oblong. It is also understood that the first and second dielectric waveguides 106, 108 may be different from each other in one or more embodiments. For example, the cladding 110 of the first waveguide 106 may have a different cross-sectional shape than the cladding 110 of the second waveguide 108.

The outer jacket 116 in FIG. 3 individually surrounds and encases each of the internal components including the shield 114, the first waveguide 106, and the second waveguide 108. For example, the outer jacket 116 may be a dielectric overmold material that is formed by extruding or molding the material around the internal components. As shown in FIG. 3, the first and second waveguides 106, 108 are spaced apart from, and not in direct mechanical contact with, the shield 114.

Figure 4:
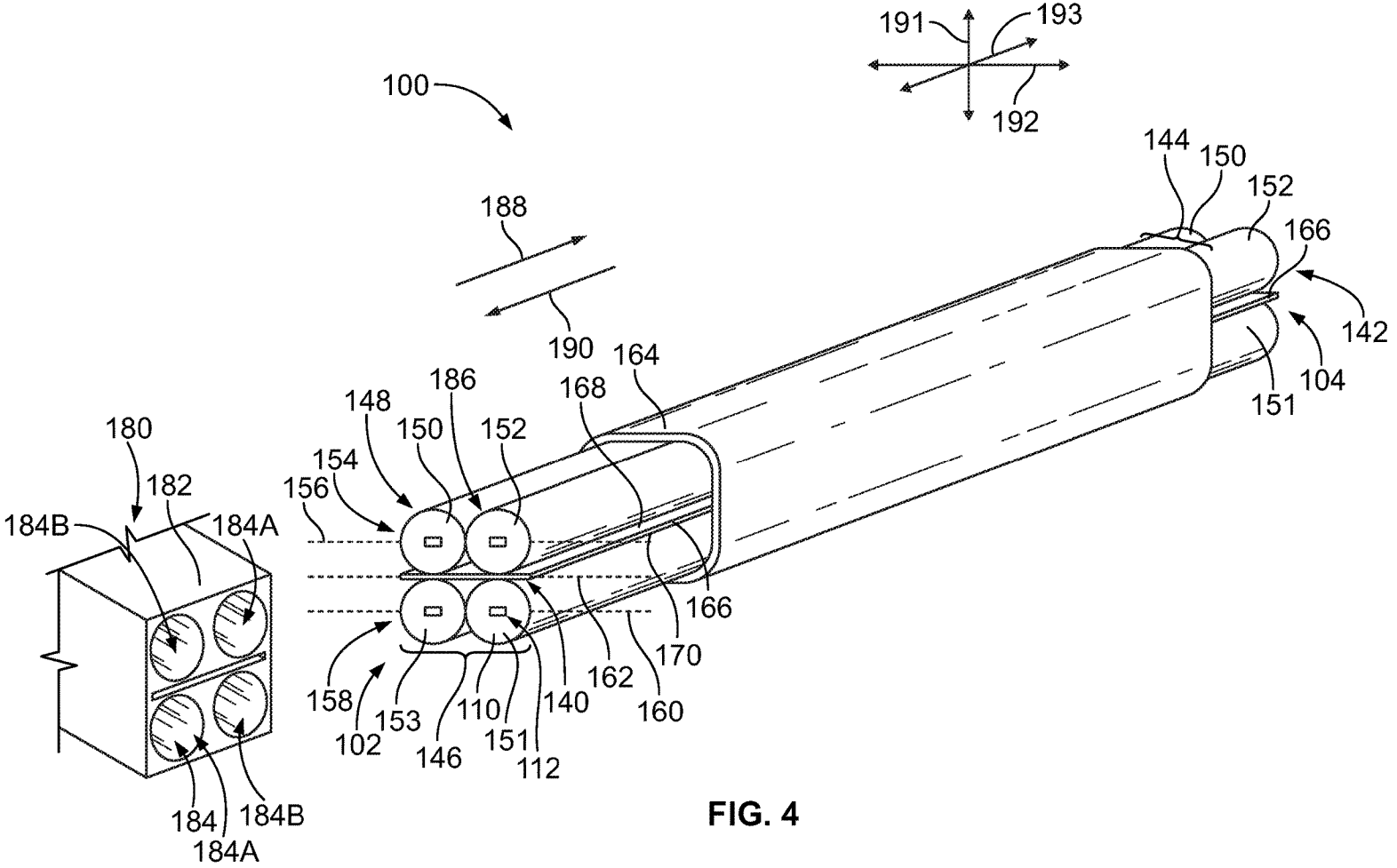
FIG. 4 is a perspective view of a portion of the waveguide assembly according to another embodiment.

FIG. 4 is a perspective view of a portion of the waveguide assembly 100 according to another embodiment. The waveguide assembly 100 is oriented with respect to a vertical or elevation axis 191, a lateral axis 192, and a longitudinal axis 193. The axes 191-193 are mutually perpendicular. Although the elevation axis 191 appears to extend in a vertical direction generally parallel to gravity, it is understood that the axes 191-193 are not required to have any particular orientation with respect to gravity.

The waveguide assembly 100 includes an electrically conductive shield 166 that is elongated between a first end 140 and a second end 142. The first and second ends 140, 142 align generally with the first and second ends 102, 104, respectively, of the waveguide assembly 100. The shield 166 may be at least similar to the shield 114 shown in FIG. 1. The shield 166 has a first or top side 168 and an opposite second or bottom side 170. As used herein, relative or spatial terms such as "first," "second," "top," "bottom," "front," and "rear" are only used to distinguish the referenced elements and do not necessarily require particular positions, orders, or orientations relative to gravity or relative to the surrounding environment of the waveguide assembly 100. The waveguide assembly 100 also includes multiple dielectric waveguides that are arranged in a cable bundle 148. The cable bundle 148 extends the length of the waveguide assembly 100 between the first and second ends 102, 104. The cable bundle 148 includes a first waveguide 150, a second waveguide 151, a third waveguide 152, and a fourth waveguide 153. The dielectric waveguides 150-153 may be identical to or at least similar to the first and second dielectric waveguides 106, 108 shown in FIG. 1. For example, each of the dielectric waveguides 150-153 includes a cladding 110 formed of a one dielectric material, and the cladding 110 defines a core region 112 therethrough that is filled with a different dielectric material, such as air or a solid plastic or other polymer. Although four waveguides 150-153 are shown in FIG. 4, the cable bundle 148 may include more or less than four waveguides in other embodiments.

The four dielectric waveguides 150-153 of the cable bundle 148 are arranged in a first pair 144 and a second pair 146. The first pair 144 is defined by the first and third waveguides 150, 152. The second pair 146 is defined by the second and fourth waveguides 151, 153. The first pair 144 is disposed along the top side 168 of the shield 166, and the second pair 146 is disposed along the bottom side 170. For example, the shield 166 may be planar and extends linearly through the cable bundle 148 such that the first pair 144 is above the top side 168 and the second pair 146 is below the bottom side 170. The first and third waveguides 150, 152 of the first pair 144 are adjacent to each other and align in a first row 154 along a first row axis 156. The second and fourth waveguides 151, 153 of the second pair 146 are adjacent to each other and align in a second row 158 along a second row axis 160. The shield 166 extends linearly between the first and second rows 154, 158 along a shield axis 162 that is approximately parallel to the first and second row axes 156, 160. The shield 166 does not surround an entire perimeter of any of the dielectric waveguides 150-153.

The dielectric waveguides 150-153 of the cable bundle 148 and the shield 166 are held together by a dielectric outer jacket 164. The outer jacket 164 engages the cladding 110 of the dielectric waveguides 150-153 and collectively surrounds the cable bundle 148 and the shield 166 along at least a portion of the length of the waveguide assembly 100. The outer jacket 164 may be at least similar to the outer jacket 116 shown in FIG. 1. Optionally, the outer jacket 164 holds the dielectric waveguides 150-153 in direct mechanical engagement with the corresponding top and bottom sides 168, 170 of the shield 166. In an alternative embodiment, at least some of the waveguides 150-153 may be spaced apart from the shield 166, such as in the embodiment shown in FIG. 3.

FIG. 4 shows a waveguide connector 180 that is configured to be connected to the first end 102 of the waveguide assembly 100. The waveguide connector 180 may be connected to a communication device (not shown) or another waveguide assembly 100. The waveguide connector 180 includes a housing 182 that defines multiple ports 184 configured to receive ends 186 of the dielectric waveguides 150-153 therein. For example, the housing 182 includes four ports 184 in the illustrated embodiment such that each port 184 receives the end 186 of one of the waveguides 150-153. The waveguide assembly 100 is used to transmit signals to and from the waveguide connector 180.

In an embodiment, each of the pairs 144, 146 of waveguides in the waveguide assembly 100 includes a transmit waveguide and a receive waveguide in reference to the waveguide connector 180. The transmit waveguide in each pair 144, 146 propagates electromagnetic signals in an outgoing direction 188 from the first end 102 of the waveguide assembly 100 (connected to the waveguide connector 180) towards the second end 104. Inversely, the receive waveguide in each pair 144, 146 propagates electromagnetic signals in an incoming direction 190 from the second end 104 towards the first end 102 (and the waveguide connector 180). The cable bundle 148 shown in FIG. 4 includes two transmit waveguides and two receive waveguides. For example, the first waveguide 150 in the first pair 144 and the second waveguide 151 in the second pair 146 may be transmit waveguides, and the third and fourth waveguides 152, 153 may be receive waveguides. The ends 186 of the transmit waveguides 150, 151 are configured to be received in two corresponding transmit ports 184A of the ports 184 of the waveguide connector 180 such that electromagnetic signals are received in the transmit waveguides 150, 151 through the respective transmit ports 184A. The ends 186 of the receive waveguides 152, 153 are configured to be received in two corresponding receive ports 184B of the ports 184 such that the waveguide connector 180 receives signals from the waveguide assembly 100 through the receive ports 184B. In one example application, the transmit waveguides 150, 151 each propagate signals in the outgoing direction 188 at 56 Gb/s and the receive waveguides 152, 153 each propagate signals in the incoming direction 190 at 56 Gb/s, resulting in a combined 112 Gb/s data transfer speed in both directions 188, 190.

Crosstalk between two waveguides that transmit signals in the same direction is referred to as "far end" crosstalk, and crosstalk between two waveguides that transmit signals in opposing direction is referred to as "near end" crosstalk. Far end crosstalk typically is more detrimental to signal integrity than near end crosstalk. In FIG. 4, the shield 166 extends between the first and second pairs 144, 146 of waveguides. Thus, the shield 166 extends between and shields the two transmit waveguides 150, 151 from each other, and the shield 166 also extends between and shields the two receive waveguides 152, 153 from each other. The shield 166 reduces far end crosstalk in the waveguide assembly 100 (as shown and described in FIG. 6 below). In the illustrated two-by-two cable bundle 148, the two transmit waveguides 150, 151 are located crosswise relative to each other to increase the distance between the two waveguides 150, 151 relative to aligning the waveguides 150, 151 directly across the shield 166 from each other. The two receive waveguides 152, 153 are also disposed crosswise relative to each other.

The shield 166 does not surround an entire perimeter of any of the transmit waveguides 150, 151 or the receive waveguides 152, 153. In the illustrated embodiment, the shield 166 does not extend between the transmit waveguide 150 and the receive waveguide 152 in the first pair 144, or between the transmit waveguide 151 and the receive waveguide 153 in the second pair 146. Thus, there may be some near end crosstalk in the waveguide assembly 100 between the two waveguides in each pair 144, 146, but near end crosstalk is significantly less detrimental than far end crosstalk. Furthermore, by limiting the amount of conductive shielding around the waveguides 150-153, the waveguide assembly 100 has acceptably low levels of loss and substantially avoids frequency cutoffs.

Figure 5:
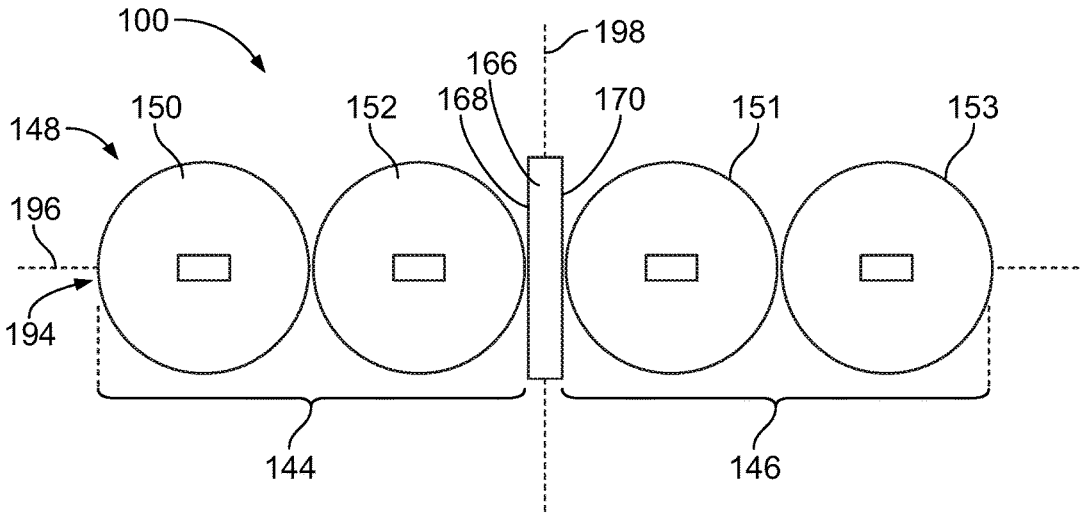
FIG. 5 is a cross-sectional view of the waveguide assembly according to another embodiment.

FIG. 5 is a cross-sectional view of the waveguide assembly 100 according to another embodiment. The illustrated embodiment includes the cable bundle 148 of four dielectric waveguides 150, 151, 152, and 153 with a shield 166 extending between some of the waveguides 150-153, as shown in the embodiment of FIG. 4. Instead of being aligned in two rows 154, 158 (shown in FIG. 4), the four dielectric waveguides 150-153 are aligned in a single row 194 along a row axis 196. The waveguide assembly 100 may have the shape of a ribbon cable that is relatively wide and thin. The shield 166 extends linearly along a shield axis 198 that is transverse to the row axis 196. In the illustrated embodiment, the shield axis 198 is orthogonal to the row axis 196. The first side 168 of the shield 166 faces the first pair 144 of waveguides (that includes the waveguides 150 and 152), and the opposite second side 170 of the shield 166 faces the second pair 146 of waveguides (that includes the waveguides 151 and 153). Optionally, the waveguides 150 and 151 are transmit waveguides, and the waveguides 152 and 153 are receive waveguides. Although not shown, the waveguide assembly 100 may be surrounded by a dielectric outer jacket.

Figure 6:
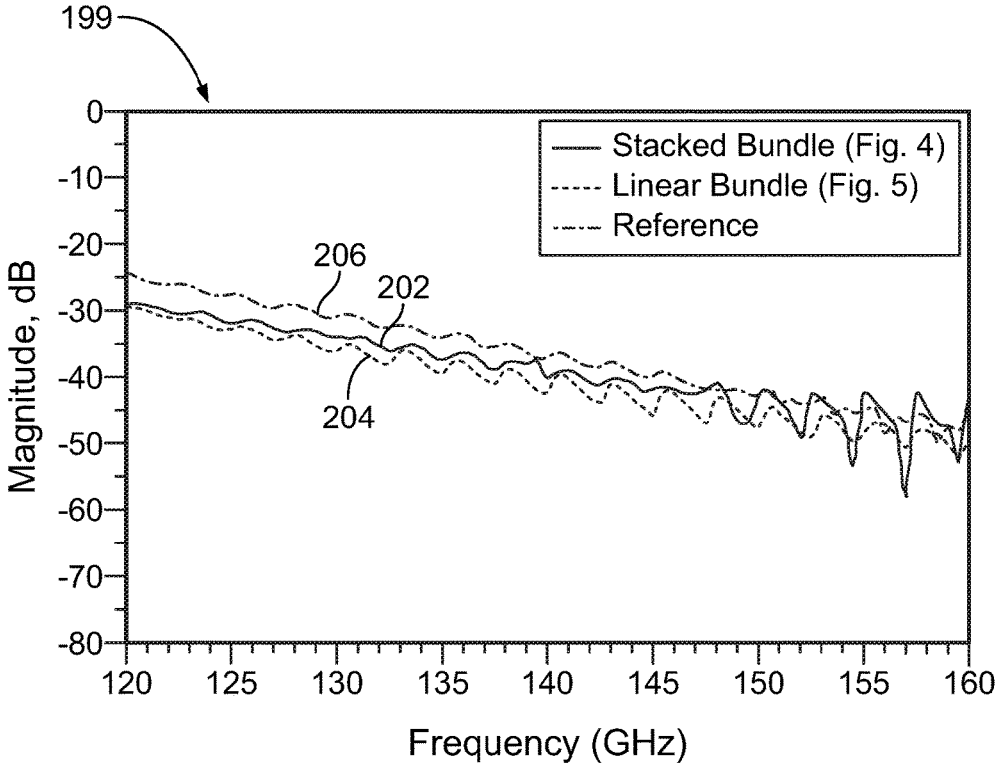
FIG. 6 is a graph comparing far end crosstalk detected in various embodiments of the waveguide assembly and a reference waveguide assembly.

FIG. 6 is a graph 199 comparing far end crosstalk (i.e. Magnitude in dB) detected in various embodiments of the waveguide assembly 100 and a reference waveguide assembly. The far end crosstalk is tested over a frequency range of 120-160 GHz. A first plotted line 202 represents far end crosstalk in the embodiment of the waveguide assembly 100 shown in FIG. 4 that has stacked pairs 144, 146 of waveguides ("stacked bundle embodiment"). A second plotted line 204 represents far end crosstalk in the embodiment of the waveguide assembly 100 shown in FIG. 5 that has linear pairs 144, 146 of waveguides ("linear bundle embodiment"). A third plotted line 206 represents far end crosstalk in a reference waveguide assembly that does not include any shield. As shown in the graph 199, the far end crosstalk in the stacked bundle embodiment 202 and the linear bundle embodiment 204 are both lower than the far end crosstalk in the reference waveguide assembly 206 in the frequency range from 120 GHz up to around 148 GHz. Thus, the stacked bundle embodiment 202 and the linear bundle embodiment 204 are desirable over the reference 206 in this frequency range due to the reduced presence of far end crosstalk that can degrade signal quality. At higher frequencies from 148 GHz to 160 GHz, the three tested assemblies are less distinguishable with respect to far end crosstalk.

Figure 7:
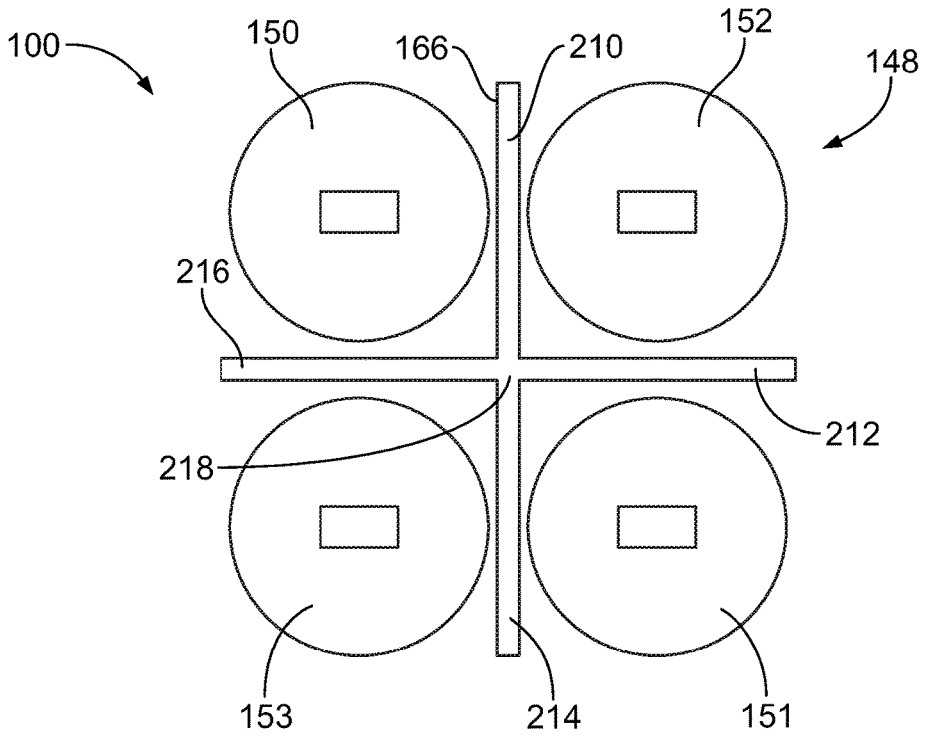
FIG. 7 is a cross-sectional view of the waveguide assembly according to another embodiment.

FIG. 7 is a cross-sectional view of the waveguide assembly 100 according to another embodiment. The illustrated embodiment has the four waveguides 150, 151, 152, and 153 stacked two-by-two in a cable bundle 148 similar to the embodiment shown in FIG. 4. In FIG. 7, however, the electrically conductive shield 166 has a cross-sectional shape in the form of a cross (or addition sign). For example, the shield 166 includes four linear segments (including a first segment 210, a second segment 212, a third segment 214, and a fourth segment 216) extending from a common hub 218. The four segments 210, 212, 214, and 216 optionally are perpendicular to each other. Each of the linear segments 210, 212, 214, and 216 extends between a different set of two of the dielectric waveguides 150-153. For example, the first segment 210 extends between waveguides 150 and 152; the second segment 212 extends between waveguides 152 and 151; the third segment 214 extends between waveguides 151 and 153, and the fourth segment 216 extends between waveguides 153 and 150. By having portions that extend between each of the adjacent waveguides 150-153, the shield 166 may significantly reduce all forms of crosstalk in the waveguide assembly 100, including both far end and near end crosstalk. The shield 166 does not fully surround any of the waveguides 150-153, though, so the loss properties of the waveguide assembly 100 may be at an acceptably low level. As shown in FIG. 7, the shield 166 does not extend around more than half of the circumference of any of the dielectric waveguides 150-153.

Figure 8:
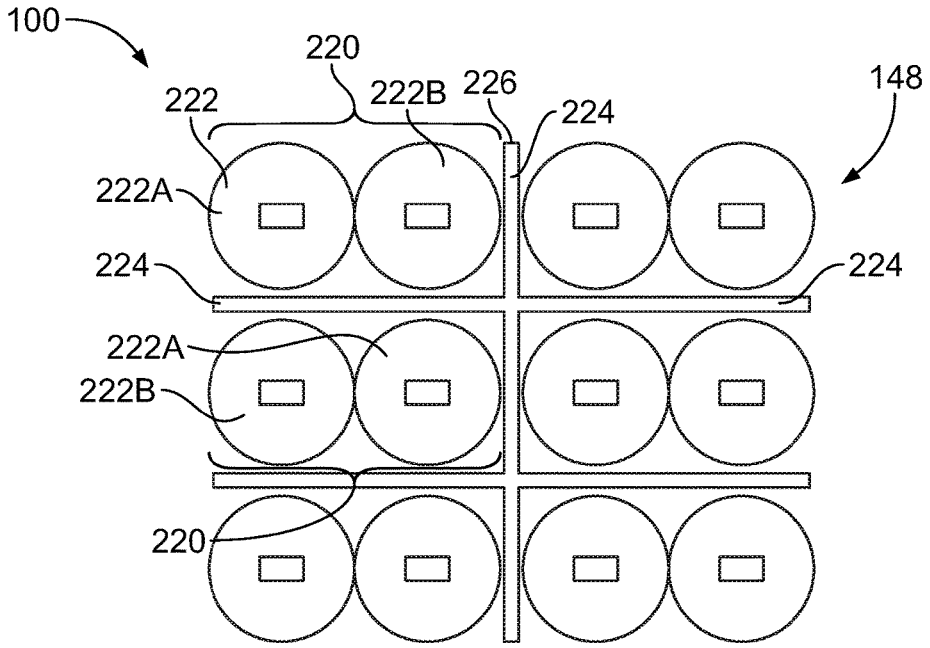
FIG. 8 is a cross-sectional view of the waveguide assembly according to another embodiment showing how the waveguide assembly is scalable.

FIG. 8 is a cross-sectional view of the waveguide assembly 100 according to another embodiment which shows how the waveguide assembly 100 is scalable to include more than four dielectric waveguides in a cable bundle 148. In the illustrated embodiment, pairs 220 of waveguides 222 are separated from one another by linear segments 224 of an electrically conductive shield 226. Each pair 220 may include one transmit waveguide 222A and one receive waveguide 222B such that the only crosstalk between the waveguides 222 in each pair 220 is the less detrimental form referred to as near end crosstalk. The linear segments 224 of the shield 226 significantly reduce far end crosstalk between adjacent pairs 220. The shield 226 does not fully surround any of the pairs 220, allowing for acceptably low loss levels and generally avoiding hard frequency cutoffs. Although not shown, the cable bundle 148 and shield 226 may be commonly surrounded by a dielectric outer jacket.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A waveguide assembly for propagating electromagnetic signals, the waveguide assembly comprising:

first and second dielectric waveguides, each of the first and second dielectric waveguides including a respective cladding formed of a first dielectric material, the respective cladding defining a corresponding core region therethrough that is filled with a second dielectric material different than the first dielectric material;

a shield disposed between the first dielectric waveguide and the second dielectric waveguide, the shield being electrically conductive; and a dielectric outer jacket engaging and commonly surrounding the cladding of the first dielectric waveguide, the cladding of the second dielectric waveguide, and the shield therebetween.

2. The waveguide assembly of claim 1, wherein the respective cladding of the first dielectric waveguide and the respective cladding of the second dielectric waveguide have round cross-sectional shapes.

3. The waveguide assembly of claim 1, wherein the shield does not surround an entire perimeter of either the first dielectric waveguide or the second dielectric waveguide.

4. The waveguide assembly of claim 1, wherein the shield is planar.

5. The waveguide assembly of claim 1, wherein the second dielectric material of the first and second dielectric waveguides is at least one of air or a solid dielectric polymer.

6. The waveguide assembly of claim 1, further comprising a third dielectric waveguide and a fourth dielectric waveguide, the first, second, third, and fourth dielectric waveguides defining a cable bundle, the shield extending linearly through the cable bundle such that the first and third dielectric waveguides are disposed on a first side of the shield and the second and fourth dielectric waveguides are disposed on a second side of the shield.

7. The waveguide assembly of claim 1, further comprising a third dielectric waveguide and a fourth dielectric waveguide, the first and third dielectric waveguides being adjacent to one another and aligned in a first row along a first row axis, the second and fourth dielectric waveguides being adjacent to one another and aligned in a second row along a second row axis that is parallel to the first row axis, the shield extending linearly between the first and second rows of dielectric waveguides along a shield axis that is parallel to the first and second row axes.

8. The waveguide assembly of claim 1, further comprising a third dielectric waveguide and a fourth dielectric waveguide, the first, second, third, and fourth dielectric waveguides defining a cable bundle, the shield having a cross cross-sectional shape with four linear segments extending from a hub, a first of the four linear segments extending between the first and third dielectric waveguides, a second of the four linear segments extending between the second and third dielectric waveguides, a third of the four linear segments extending between the second and fourth dielectric waveguides, a fourth of the four linear segments extending between the first and fourth dielectric waveguides.

9. The waveguide assembly of claim 1, further comprising a third dielectric waveguide and a fourth dielectric waveguide, the first, second, third, and fourth dielectric waveguides being aligned in a row along a row axis, the shield extending linearly along a shield axis that is orthogonal to the row axis, the first and third dielectric waveguides being disposed on a first side of the shield and the second and fourth dielectric waveguides being disposed on a second side of the shield.

10. The waveguide assembly of claim 1, wherein the first and second dielectric waveguides are both transmit waveguides.

11. The waveguide assembly of claim 10, further comprising a third dielectric waveguide and a fourth dielectric waveguide that are both receive waveguides, the first and third dielectric waveguides being adjacent to one another and defining a first pair, the second and fourth dielectric waveguides being adjacent to one another and defining a second pair, the shield extending between the first and second pairs to shield the transmit waveguides from each other and to shield the receive waveguides from each other.

12. A waveguide assembly extending a length between a first end and a second end, the waveguide assembly comprising:

a transmit dielectric waveguide including a respective cladding formed of a first dielectric material, the cladding defining a corresponding core region therethrough that is filled with a second dielectric material that is different than the first dielectric material, the transmit dielectric waveguide propagating electromagnetic signals in an outgoing direction from the first end of the waveguide assembly towards the second end;

a receive dielectric waveguide including a respective cladding formed of the first dielectric material, the cladding of the receive dielectric waveguide defining a corresponding core region therethrough that is filled with the second dielectric material, the receive dielectric waveguide propagating electromagnetic signals in an incoming direction from the second end of the waveguide assembly towards the first end; and a dielectric outer jacket engaging and commonly surrounding the cladding of the transmit dielectric waveguide and the cladding of the receive dielectric waveguide.

13. The waveguide assembly of claim 12, wherein the transmit and receive dielectric waveguides define a first pair, the waveguide assembly further comprising a second pair comprising another transmit dielectric waveguide and another receive dielectric waveguide, the waveguide assembly further comprising an electrically conductive shield disposed between the first pair and the second pair within the dielectric outer jacket, the shield configured to shield the transmit waveguides of the first and second pairs from each other and to shield the receive waveguides of the first and second pairs from each other.

14. The waveguide assembly of claim 13, wherein the shield does not surround an entire perimeter of any of the transmit dielectric waveguides or the receive dielectric waveguides.

15. The waveguide assembly of claim 12, wherein the second dielectric material of the transmit dielectric waveguide and the second dielectric material of the receive dielectric waveguide are each at least one of air or a solid dielectric polymer.

16. A waveguide assembly for propagating electromagnetic signals, the waveguide assembly comprising:

an electrically conductive shield being elongated to extend between a first end and a second end, the shield having a first side and an opposite second side;

a first pair of dielectric waveguides extending between the first and second ends and being disposed on the first side of the shield; and a second pair of dielectric waveguides extending between the first and second ends and being disposed on the second side of the shield;

wherein each of the first and second pairs includes a respective transmit waveguide and a respective receive waveguide, the respective transmit waveguides propagating electromagnetic signals in an outgoing direction from the first end towards the second end, the respective receive waveguides propagating electromagnetic signals in an incoming direction from the second end towards the first end, each of the dielectric waveguides in the first and second pairs having a respective cladding formed of a first dielectric material, the respective cladding of each of the dielectric waveguides defining a corresponding core region therethrough that is filled with a second dielectric material that is different than the first dielectric material.

17. The waveguide assembly of claim 16, further comprising a dielectric outer jacket commonly surrounding the first pair of dielectric waveguides, the second pair of dielectric waveguides, and the shield therebetween.

18. The waveguide assembly of claim 16, wherein the shield does not surround an entire perimeter of any of the dielectric waveguides.

19. The waveguide assembly of claim 16, wherein the shield is planar.

20. The waveguide assembly of claim 16, wherein the first pair of dielectric waveguides is aligned in a first row along a first row axis, the second pair of dielectric waveguides being aligned in a second row along a second row axis that is parallel to the first row axis, the shield extending linearly between the first and second rows of dielectric waveguides along a shield axis that is parallel to the first and second row axes.

21. The waveguide assembly of claim 16, wherein the first pair of dielectric waveguides and the second pair of dielectric waveguides are aligned in a row along a row axis, the shield extending linearly along a shield axis that is orthogonal to the row axis.

* * * * *